United States Patent [19]

Linder et al.

[11] 4,116,122

[45] Sep. 26, 1978

[54] HYDRAULIC DRIVEN PRESS

[75] Inventors: Ernst Linder, Bellach; Kurt Thut, Schnottwil, both of Switzerland

[73] Assignee: Osterwalder AG, Lyss, Switzerland

[21] Appl. No.: 840,948

[22] Filed: Oct. 11, 1977

[30] Foreign Application Priority Data

Oct. 11, 1976 [DE] Fed. Rep. of Germany ..... 2645849

[51] Int. Cl.[2] ..... B30B 15/16

[52] U.S. Cl. ..... 100/48; 72/19; 72/453.01; 83/72; 83/639; 100/269 R

[58] Field of Search ..... 100/43, 48, 53, 256, 100/269 R; 83/639, 72, 74, 617; 72/453.01, 18, 19, 20, 21, 22

[56] References Cited

U.S. PATENT DOCUMENTS

| | | | |
|---|---|---|---|
| 3,138,976 | 6/1964 | Robra | 100/48 |
| 3,196,647 | 7/1965 | Schneider | 72/21 |
| 3,416,433 | 12/1968 | Gutnikov | 100/48 |
| 3,888,168 | 6/1975 | Kent | 100/48 |

FOREIGN PATENT DOCUMENTS

| | | | |
|---|---|---|---|
| 1,210,877 | 11/1970 | United Kingdom | 100/48 |
| 296,381 | 3/1974 | U.S.S.R. | 100/48 |

*Primary Examiner*—Billy J. Wilhite
*Attorney, Agent, or Firm*—Gordon W. Hueschen

[57] ABSTRACT

A hydraulic driven press for embossing, bending, stamping, especially fine or precision blanking, comprising a plunger or ram guided in an upright or stand. The plunger or ram is supported at the stand by means of pressure chambers and a piston, the pressure chambers comprising at least one actuation pressure compartment and a counter pressure compartment which are supplied by a pump or the like with a pressurized medium. Devices measure and determine the displacement path of the plunger or ram and the plunger or ram speed as well as the delivered quantity of pressurized medium. There is also provided a regulation device for regulating plunger or ram movement as a function of the aforementioned measurement values.

7 Claims, 3 Drawing Figures

2a
6
11
10
5
2
1
3
4a
7
4
9
21
22
20
8
21
22
7'
5'
6'
12
13
14
T
23
24
18
17
19
16
15
15a
M

HYDRAULIC DRIVEN PRESS

BACKGROUND OF THE INVENTION

The present invention relates to a new and improved construction of a hydraulic driven press for embossing, bending, stamping, especially for fine or precision blanking, which is of the type comprising a plunger or ram guided in a stand or support, this plunger or ram being supported by means of pressure chambers and a piston at the stand, such pressure chambers comprising at least one actuation pressure chamber and one counter pressure chamber.

During fine or precision blanking it is extremely important that the plunger or ram moves uniformly during the cutting operation, since otherwise there are not obtained clean cutting surfaces and the longevity of the tools is reduced.

With the heretofore known fine or precision blanking presses the desired cutting speed is achieved in that there is forced a certain quantity of oil into the punch cylinder by means of a pump or a volume regulator.

Experience has shown that the speed of the ram cannot be maintained constant because the forces which act upon the ram during the cutting operation continuously change due to a reduction of the cutting forces and material hardening, and owing to the hydraulic resilient action which prevails because of the build-up and relaxation of the oil column in the cylinder there arise deceleration and acceleration phenomenas at the ram. It is therefore necessary to select the cutting speed so small that the speed changes only have a slight effect upon the quality of the parts and the longevity or service life of the tools.

SUMMARY OF THE INVENTION

Hence, it is a primary object of the present invention to provide an improved construction of hydraulic driven press which is not associated with the aforementioned drawbacks and limitations of the prior art proposals.

Another and more specific object of the present invention aims at providing a new and improved construction of a hydraulic driven fine or precision blanking press, the ram or plunger of which moves in an exactly controlled manner, and the speed can be constant or proceed according to a predetermined curve.

There is already known to the art from German Pat. No. 1,427,403 a hydraulic driven press where there is provided apart from an actuation pressure chamber or compartment a counter pressure chamber or compartment which opposes the working movement of a hydraulic resistance which is additive to the cutting resistance of the workpiece. Yet, this hydraulic resistance cannot be accommodated in the desired manner to all phases of the incremental movement, so that there cannot be realized any controlled speed of the ram movement.

Now in order to implement the above objects and others which will become more readily apparent as the description proceeds, the press of the present development is manifested by the features that there are provided devices for measuring and determining the displacement path of the ram and the ram speed as well as the delivered quantity of pressurized medium. A regulation device serves to regulate the ram movement as a function of the aforementioned measurement values. There are thus continuously measured and determined the ram speed and the ram displacement path (actual values) and compared with appropriate predetermined magnitudes (reference values) by means of a reference value-actual value comparison. Any occurring regulation deviations are corrected.

A servo-valve can be advantageously employed as the adjustment device for influencing the quantity of pressurized medium delivered to the pressure chambers and thus the displacement path of the ram. A servo-valve has the advantage, in contrast to standard slide valves that the reaction time only requires fractions of a second.

With the press according to the invention it is possible, with the most exact control of the displacement path and without danger for the die and the punch, to work more rapidly than with prior art presses.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
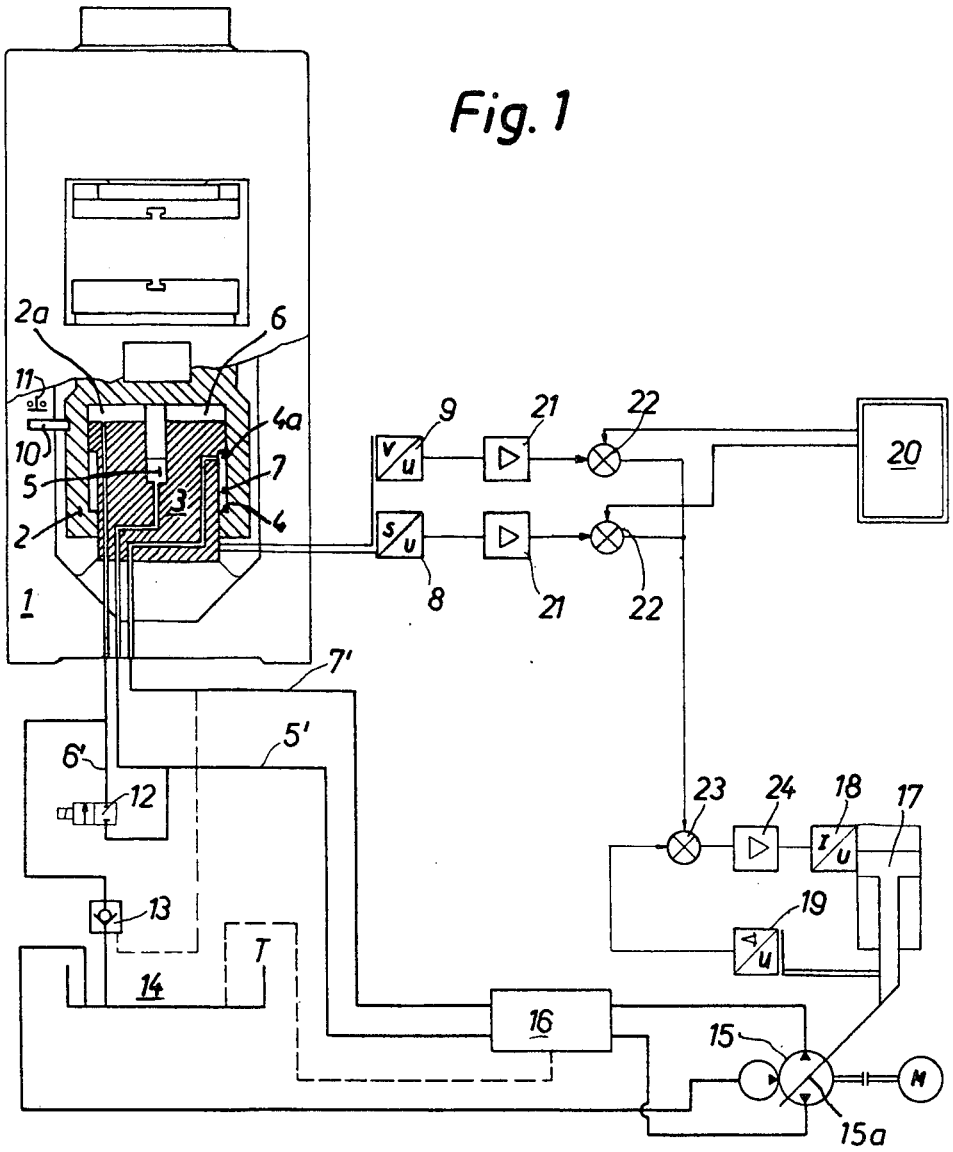
FIG. 1 schematically illustrates a first exemplary embodiment of hydraulic driven press, partly in sectional view, constructed according to the invention.

Describing now the drawings, in the exemplary embodiment of hydraulic driven press as shown in FIG. 1 reference character 1 designates a press support means or stand and reference character 2 a plunger or ram. The ram 2 is constructed as a triple-acting cylinder and supported at the stand or support means 1 by a piston 3. The piston 3 is structured as a triple-acting piston and received in a cylinder recess 2*a* of the ram 2. In the ram-cylinder 2 there are located the pressure chambers 5, 6 and 7 which are supplied with a pressurized fluid medium by means of the lines or conduits 5', 6' and 7' respectively.

At the ram 2 there is arranged a stop or impact member 4 which in conjunction with a stop or impact surface 4*a* arranged at the piston 3, determines the end position of the ram or plunger 2. At the ram 2 there is mounted a switching arm 10 which, upon reaching the end or terminal position, actuates a terminal switch 11 arranged at the support or support means 1, this terminal switch initiating the return movement of the ram 2 after a short holding time.

Now between the piston 3 and the ram 2 there are arranged a displacement path-measuring device 8 and a velocity or speed measuring device 9. In a branch of the conduit or line 5' there is provided a valve 12 by means of which the line or conduit 6' can be supplied with the pressurized medium. The line 6' is connected by means of a filling valve 13 with a tank 14. The lines or conduits 5' and 7' are supplied with the pressurized medium by means of an adjustable pump 15. The flow of the pressurized medium delivered by the pump 15 can be reversed in such a manner that such pressurized medium either flows through the line or conduit 5' or the line or conduit 7'. The pump 15 may be in the form of a wobble plate pump wherein the selectively adjustable angular position of its wobble plate, generally indicated by reference character 15*a*, is decisive for the delivered quantity of pressurized fluid medium. This angular position can be altered by means of an adjustment device in the form of a control piston 17, which in turn is controlled by a servo-valve 18. The position of the control piston 17 and thus the angular position of the wobble plate which is decisive for the quantity of pressurized fluid medium delivered by the pump 15 is continuously measured by means of an angle measuring device 19. The reference values which are desired for a given work cycle are preselected by means of the program transmitter or programmer 20. Pump 15 also may be, for instance, an axial piston pump having delivery adjustment means, which can be conceptionally considered as constituted by element 15*a* and positionally controlled by control piston 17.

The actual values which are delivered by the displacement path-measuring device 8 and the speed measuring device 9 are continuously compared with the aid of the amplifiers 21 at the actual value-reference value comparison locations or devices 22 (comparators) with the reference values of the program transmitter 20 and delivered in the form of a corrected, composite reference value-output signal to a further actual value-reference value comparison location or device 23. At the comparison device or comparator 23 the actual value of the angle measuring device is compared with the reference value and delivered in the form of a corrected reference value by means of an amplifier 24 to the servo-valve 18. The servo-valve 18 controls the control piston 17 in such a manner that the pump 15 delivers the pressurized fluid medium in the desired manner.

At the beginning of the movement course of the ram 2 the pressurized fluid medium is delivered by the pump 15 via the line 5' into the chamber or compartment 5. The pump 15 is regulated such that the actual value-speed of the ram 2 coincides with the reference value-speed which is prescribed by the program transmitter 20. At the same time by means of the line 6' and the filling valve 13 the pressure chamber or compartment 6 is filled with pressurized fluid medium. This first part of the course of the movement serves to bridge the idle stroke. At a point preselected by the program transmitter 20 and controlled by the displacement path-measuring device 8 the valve 12 opens and the pump 15 now simultaneously delivers by means of the lines or conduits 5' and 6' pressurized fluid medium to the chambers 5 and 6. Since the pressure increases in the line 6' the filling valve 13 is closed. The further course of movement of the ram 2 now is accomplished according to the further infeed or command of the program transmitter 20. This part of the course of movement constitutes the actual work stroke. Due to the deformation of the workpiece by the not particularly illustrated tool the pressure in the chambers 5 and 6 increases to a value corresponding to the deformation work.

Since during the punching operation the deformation or shaping work continuously changes and thus there likewise continuously changes the resistance acting upon the ram 2, the pressure in the chambers 5 and 6 also changes. A pressure change would cause an uncontrolled speed change. Now since, however, the displacement path and speed of movement of the plunger are continuously measured by the displacement path-measuring device 8 and the speed measuring device 9 and compared with the reference value, the slightest difference between the actual value and reference value causes, by means of the comparison devices 22 and 23 and the amplifier 24, regulation of the servo-valve 18 and thus the delivery capacity of the pump 15 to be accomplished in such a manner that the ram 2, notwithstanding pressure change in the chambers 5 and 6, is moved in a manner prescribed by the program transmitter 20.

Now if the stop or impact member 4 is positioned against the stop or impact surface 4*a*, then the ram 2 has reached its end or terminal position and the switching-arm 10 actuates the terminal switch 11. Following a short holding time the pump 15 is controlled such that the pressure chamber or compartment 7 is pressure impinged by means of the line 7' and the chambers 5 and 6 are emptied. As a result the ram 2 moves rearward and the speed is likewise regulated in the previously described manner. If the ram 2 has reached the lower terminal position which has been preselected by the program transmitter 20, then after a certain holding time there is initiated the next stroke.

Figure 2:
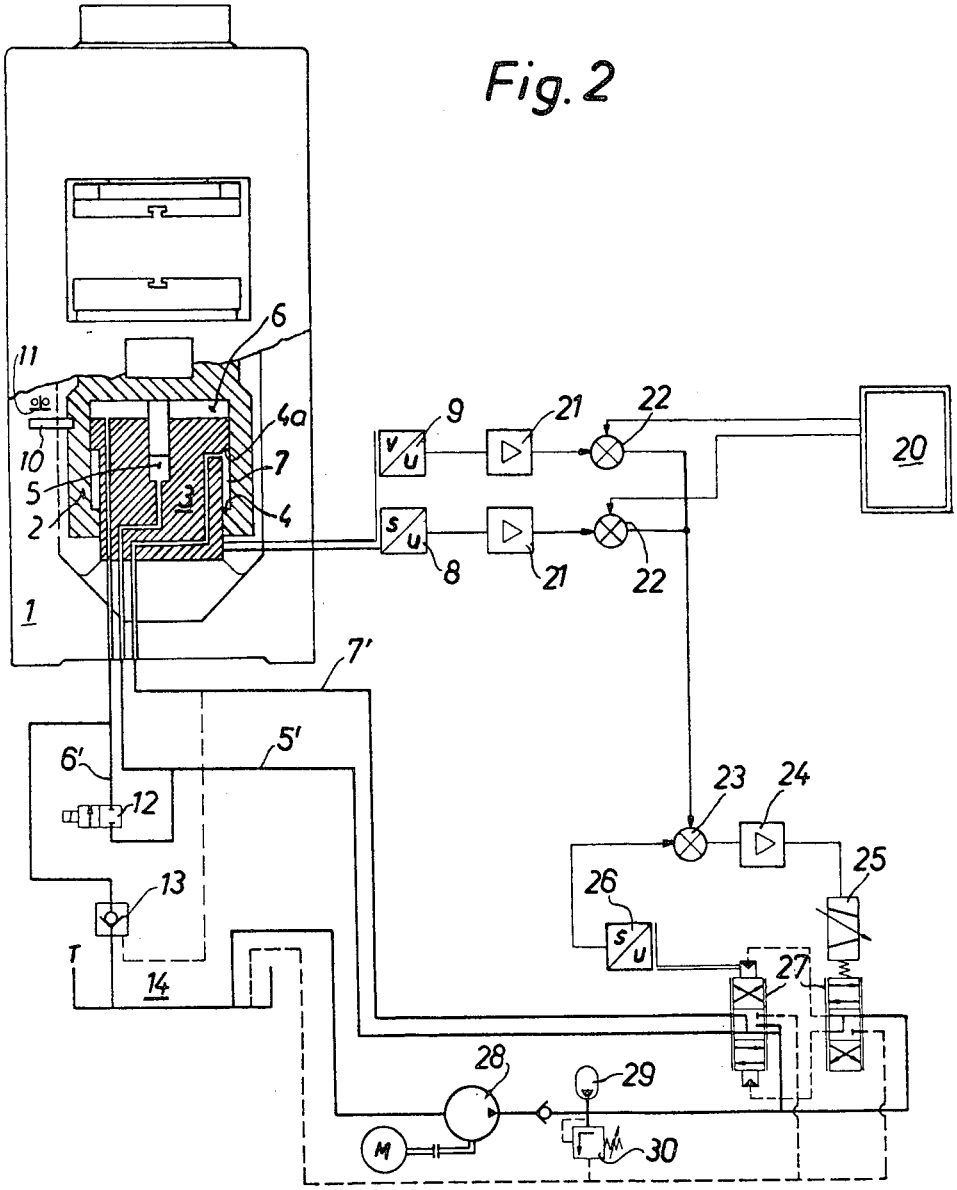
FIG. 2 is a showing similar to the arrangement of FIG. 1 but of a second exemplary embodiment of hydraulic driven press.

The exemplary embodiment of press depicted in FIG. 2 differs from that of FIG. 1 in that here for controlling the pressurized fluid medium there is employed a pump 28 having a pressure reservoir or store 29 and a safety valve 30 as well as a servomotor 25, a servo-valve 27 and a displacement path-measuring device 26.

The pump 28 and the pressure reservoir or storage 29 ensure that there is always available sufficient pressurized fluid medium in front of the servo-valve 27.

The regulation deviation which is formed at the actual value-reference value-comparison location or device 23 is delivered by means of the amplifier 24 to the servomotor 25 with controls a not particularly referenced piston of the servo-valve 27 such that the desired quantity of oil is delivered to the desired line or conduit 5' or 6'. The displacement path-measuring device 26 measures the position of the piston within the servo-valve 27 and further conducts the measurement signal in the form of an actual value to comparison location or comparator 23. At the comparator 23 there are compared with one another the actual value and reference value and the measurement result is delivered in the form of a new reference value to the servomotor 25.

Figure 3:
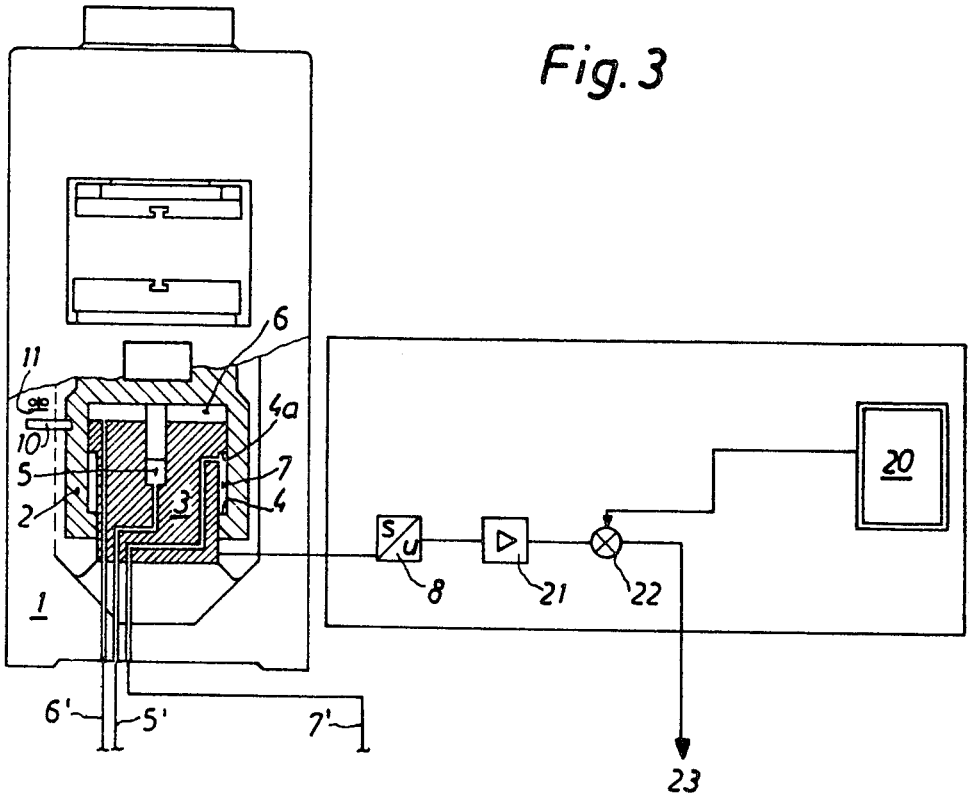
FIG. 3 schematically illustrates a third exemplary embodiment of hydraulic driven press.

Finally, the embodiment of FIG. 3 differs from that of FIGS. 1 and 2 in that here the speed is not directly determined by means of a speed measuring device, rather by a computer which is part of the program transmitter 20, by dividing the value measured by the displacement path-measuring device 8 by the time.

While there are shown and described present preferred embodiments of the invention, it is to be distinctly understood that the invention is not limited thereto, but may be otherwise variously embodied and practiced within the scope of the following claims.

What is claimed is:

1. A hydraulic driven press for embossing, bending, stamping, especially for precision blanking, comprising:

support means;

a ram guided in said support means;

pressure chambers and a piston provided for said ram;

said ram being supported at said support means by said pressure chambers and said piston;

said pressure chambers comprising at least one actuation pressure chamber and a counter pressure chamber;

means for supplying a pressurized medium to said actuation pressure chamber and said counter pressure chamber;

means for measuring and determining the displacement path of the ram and the ram speed and the quantity of delivered pressurized medium and for delivering measurement values representative of such measurement operations;

a regulation device for regulating the ram movement as a function of the measurement values measured by said measuring means.

2. The press as defined in claim 1, wherein:

said means for supplying said pressurized medium comprises a pump.

3. The press as defined in claim 1, wherein:

said piston is supported by said support means;

said regulation device comprises a program transmitter in which there are stored reference values for the displacement path and speed of movement, respectively, of said ram;

first reference value-actual value comparison means for comparing the stored reference values with said measurement values and for delivering output signals;

second reference value-actual value comparison means to which there is delivered a first input magnitude combined from the output signals of the first reference value-actual value comparison means and as a second input magnitude a measurement value for the quantity of pressurized medium delivered to the pressure chambers;

an adjustment device for adjusting the delivered quantity of pressurized medium supplied by said supply means; and said second reference value-actual value comparison means delivering an output magnitude (regulation deviation) to said adjustment device for adjusting the delivered quantity of pressurized medium supplied by said supply means.

4. The press as defined in claim 3, wherein:

said means for supplying said pressurized medium comprises an axial piston pump embodying delivery adjustment means;

said adjustment device comprising a control piston for changing the position of said delivery adjustment means of said pump; and a measuring device for measuring the position of the delivery adjustment means of said pump.

5. The press as defined in claim 3, wherein:

said means for supplying said pressurized medium comprises a wobble plate pump having a selectively angularly positionable wobble plate;

said adjustment device comprising a control piston for altering the angular position of said wobble plate.

6. The press as defined in claim 3, wherein:

said adjustment device comprises a servomotor;

said means for supplying said pressurized medium comprises a pump;

a control slide means operated by said pump;

said servomotor controlling the control slide means for dosing the quantity of pressurized medium delivered by said pump; and a displacement path-measuring device for measuring the position of the control slide means.

7. The press as defined in claim 1, wherein:

said piston comprises a triple-acting piston structure;

said ram having a cylinder recess for receiving said triple-acting piston structure.

* * * * *